US012613049B2

(12) United States Patent
Rion

(10) Patent No.: US 12,613,049 B2
(45) Date of Patent: Apr. 28, 2026

(54) AIR HANDLING UNIT

(71) Applicant: Carrier Corporation, Palm Beach Gardens, FL (US)

(72) Inventor: Loris Rion, Aix-les-Bains (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 467 days.

(21) Appl. No.: 18/177,427

(22) Filed: Mar. 2, 2023

(65) Prior Publication Data

US 2023/0288090 A1 Sep. 14, 2023

(30) Foreign Application Priority Data

Mar. 9, 2022 (EP) ..... 22161188

(51) Int. Cl.
*F24F 11/63* (2018.01)
*F24F 7/007* (2006.01)
*F24F 11/74* (2018.01)

(52) U.S. Cl.
CPC ..... *F24F 11/63* (2018.01); *F24F 7/007* (2013.01); *F24F 11/74* (2018.01)

(58) Field of Classification Search
CPC ..... F24F 11/63; F24F 11/74; F24F 7/007
USPC ..... 454/229
See application file for complete search history.

(56) References Cited

U.S. PATENT DOCUMENTS 6,016,710 A 1/2000 Boles et al.
6,328,095 B1 12/2001 Felber et al.
6,505,502 B1 1/2003 Brownell et al.
6,575,228 B1 6/2003 Ragland et al.
7,886,986 B2 2/2011 Fischer, Jr. et al.
8,584,733 B2 11/2013 D'Arcy et al.
8,943,848 B2 2/2015 Phannavong
9,115,909 B2 8/2015 Mckie et al.
9,404,668 B2 8/2016 Mckie et al.
9,897,338 B2 2/2018 Fan et al.
9,907,214 B2 2/2018 Dagley et al.
10,364,995 B2 7/2019 Fischer et al.
(Continued)

FOREIGN PATENT DOCUMENTS

EP 2427698 B1 8/2019
EP 3598016 A1 1/2020
(Continued)

OTHER PUBLICATIONS

European Search Report for Application No. 22161188.2; Issued Aug. 16, 2022; 10 Pages.

*Primary Examiner* — Avinash A Savani
*Assistant Examiner* — Dana K Tighe
(74) *Attorney, Agent, or Firm* — CANTOR COLBURN LLP

(57) ABSTRACT

An air handling unit includes an air treatment unit for treating at least a part of the fresh air via a treatment that gives rise to a pressure drop as well as a mixing damper for controlling air flow between a return air pat, and a supply air path for allowing recycling of air from a return air inlet to a supply air outlet. A supply fan sensor is used for measuring a parameter associated with air flow across the supply fan. An air treatment unit sensor is used for measuring a pressure drop across the air treatment unit in the supply air path. The air handling unit has a control system in order to determine the rate of fresh air flow, as well as optionally other control functions.

14 Claims, 1 Drawing Sheet

(56) References Cited

U.S. PATENT DOCUMENTS

| | | | | |
|---|---|---|---|---|
| 10,823,447 | B2 | 11/2020 | Mckie et al. | |
| 2022/0137649 | A1* | 5/2022 | Karamanos | G05D 7/0635 700/276 |
| 2023/0273576 | A1* | 8/2023 | Douglas | G05B 15/02 700/276 |

FOREIGN PATENT DOCUMENTS

| | | | |
|---|---|---|---|
| EP | 3207315 | B1 | 3/2020 |
| EP | 3278034 | B1 | 1/2021 |
| WO | 2016060609 | A1 | 4/2016 |
| WO | 2016159857 | A1 | 10/2016 |

* cited by examiner

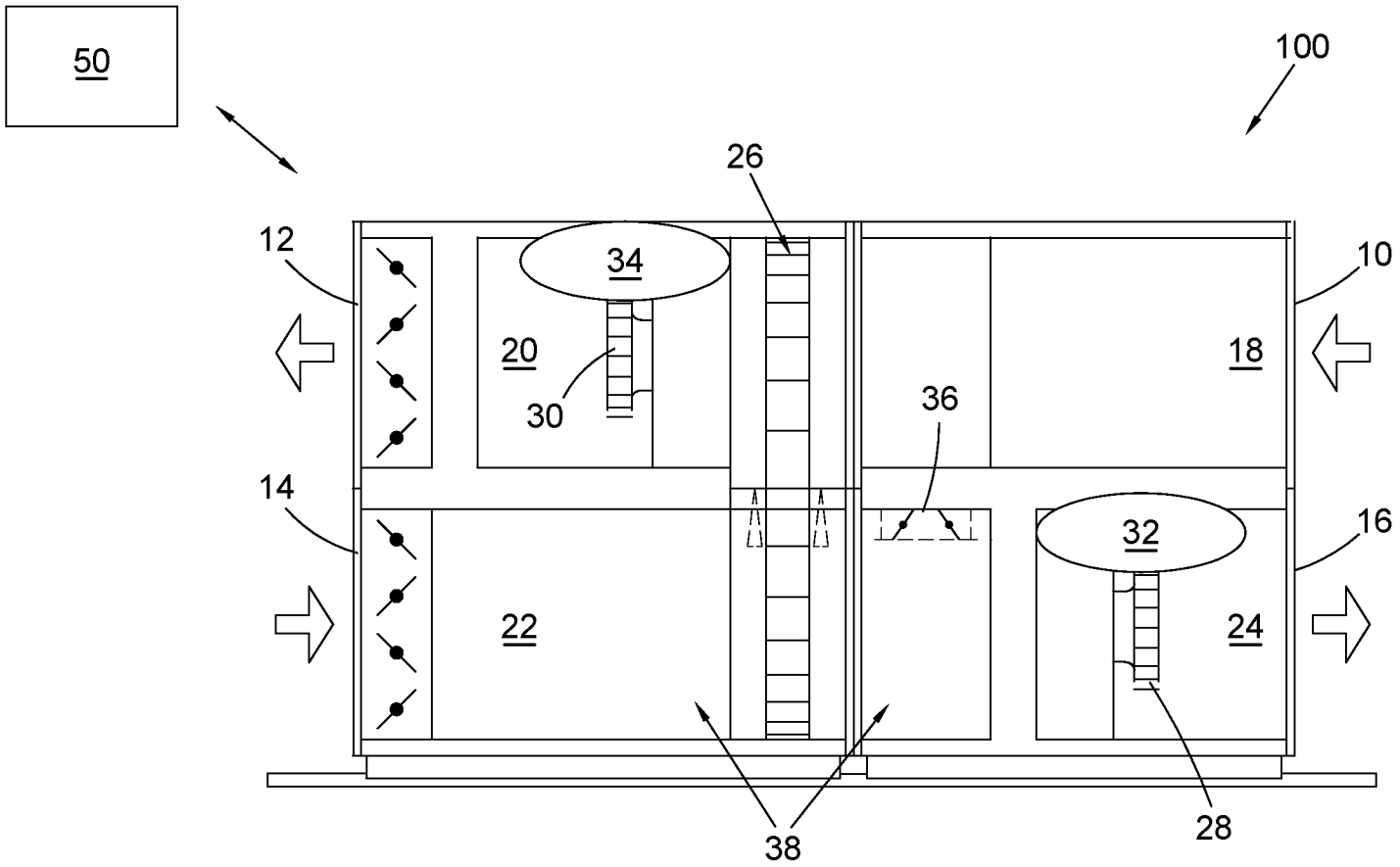
100
10
16
18
24
28
32
36
26
38
34
30
20
22
12
14
50

AIR HANDLING UNIT

FOREIGN PRIORITY

This application claims priority to European Patent Application No. 22161188.2, filed Mar. 9, 2022, and all the benefits accruing therefrom under 35 U.S.C. § 119, the contents of which in its entirety are herein incorporated by reference.

TECHNICAL FIELD OF INVENTION

The present invention relates to an air handling unit (AHU) as well as to a method for configuring and/or controlling an AHU. In example embodiments the AHU is used within a heating, ventilation and air conditioning (HVAC) system, such as for a building HVAC system provided for controlling temperature and/or humidity of the air within a building.

BACKGROUND OF THE INVENTION

Buildings build to modern standards typically have excellent thermal insulation with the interior generally well-sealed from the outside. This means that there is very limited transfer of air from the outside to renew the air of the inside of the building. This can create bad air within a building, as in so called "sick building" syndrome, and to address this buildings generally include systems for renewal of the air using air from outside. Where there is an air conditioning system or other system for control of the building air temperature and/or humidity then air renewal openings (e.g. doors and/or windows) to the outside has disadvantages due to unwanted/uncontrolled loss or gain in temperature or humidity. This issue can be addressed by treating the air in order to allow for transfer of heat and/or humidity transfer between return/exhaust air and fresh/supply air. Other types of treatments are also known, such as filtering of the fresh air.

It is also known for an AHU to include a mixing damper for controlling air flow between the return air path and the supply air path and for allowing recycling of air from the return air inlet to the supply air outlet. The mixing damper may be closed to ensure maximum intake of fresh air if needed, or it may be partially or fully opened to allow for a proportion of the return air to be recirculated within the supply air. This is beneficial in order to avoid loss of heat via exhausting of the return air, such as to reduce energy use for a building using the AHU. The mixing damper may be controlled according to various considerations such as energy usage/heat recovery as well as a required fresh air volume/ratio. The required fresh air volume/ratio may be set by the user or it may be adjusted automatically based on considerations such as monitoring of the indoor air quality (IAQ) by sensors external to the AHU.

Within all such systems it is important to enable accurate control of the air flows, such as based on temperature monitoring and/or user requirements. The prior art systems therefore also may include sensors for determining air flow, such as fan sensors for providing information about the rate of air flow at a fan.

SUMMARY OF THE INVENTION

Viewed from a first aspect, the invention provides an air handling unit comprising: a return air inlet for receiving return air; an exhaust air outlet for expelling exhaust air to atmosphere; a fresh air inlet for receiving fresh air from atmosphere; a supply air outlet for providing supply air; an air treatment unit for treating at least a part of the fresh air via a treatment device that gives rise to a pressure drop; an exhaust fan for urging air along a return air path from the return air inlet toward the exhaust air outlet; a supply fan for urging air along a supply air path from the fresh air inlet via the air treatment unit to the supply air outlet; a mixing damper for controlling air flow between the return air path and the supply air path and for allowing recycling of air from the return air inlet to the supply air outlet; a supply fan sensor for measuring a parameter associated with air flow across the supply fan; an exhaust fan sensor for measuring a parameter associated with air flow across the exhaust fan; an air treatment unit sensor for measuring a pressure drop across the air treatment unit in the supply air path; and a control system comprising a memory for data storage and a processor for determining operating parameters of the air handling unit, wherein the control system receives input from the supply fan sensor, the exhaust fan sensor, and the air treatment unit sensor, wherein the memory comprises stored air flow data concerning a relationship between a rate of fresh air flow at the fresh air inlet and the measured pressure drop across the air treatment unit, and wherein the processor is configured to use the stored air flow data and the measured pressure drop to determine the rate of fresh air flow.

With this air handling unit, and by use of the stored data at the processor, it becomes possible to determine all of the air flows in the air handling unit with measurements from the two fan sensors and the pressure drop measured for the air treatment unit. The rate of fresh air flow is determined as set out above, and in addition the processor may readily determine the rate of air flow at the supply fan and the exhaust fan by means of signals from the supply fan sensor and exhaust fan sensor, i.e. by use of measurements of the parameters associated with air flow across the two fans. When these three air flows are known (fresh air, exhaust air, and supply air) then the rate of return air flow can also be deduced. Thus, by means of the stored air flow data and the measure of air at the air treatment unit then the air handling unit of the first aspect allows for all air flows to be known in a way that is not possible without this use of the pressure drop over the air treatment unit. This then allows for improved control of the speed of the exhaust fan and/or the supply fan, even when the mixing damper is fully or partly open. This adds control/measurement abilities that are otherwise not possible without use of the system of the first aspect, or that are more complex to implement using prior art systems.

In example embodiments the stored air flow data is data that has been obtained by a calibration process including measuring the differential pressure at the air treatment unit with the mixing damper fully closed and the supply fan speed varying. As the supply fan sensor provides a parameter associated with air flow across the supply fan then it is possible to use this sensor to determine a rate of air flow, allowing known rates of air flow across the air treatment unit to be mapped against the pressure drop measured by the air treatment unit sensor. This gives a way to determine a relationship between the pressure drop at the air treatment unit (referenced herein as dP) and the air flow through the air treatment unit. This relationship holds even when the mixing damper is opened during later use and the supply air flow is hence no longer the same as the fresh air flow. This relationship may thus be used to provide the stored air flow data for the memory of the processor.

Advantageously, this calibration process can be performed quickly and easily to give stored air flow data that is specific for the air handling unit and for its air treatment unit. This is hence more accurate than using manufacturer data, modelling data or laboratory test data, which necessarily gives an estimate for a particular component or combination of components that may differ from an empirical measure of the air treatment unit in question, when it is in situ in the air handling unit, in line with the proposed calibration process. In addition, the calibration process can easily be repeated during use of the air handling unit, hence avoiding 'drift' in accuracy that may otherwise occur, e.g. as the condition of the air handling unit and/or of the air treatment unit changes with use. For example, the calibration process may be repeated periodically, e.g. during maintenance or inspection of the air handling unit, and/or when components are replaced or cleaned.

The stored air flow data may for example take the form of a look-up table stored via the memory, whereby a given differential pressure measurement at the air treatment unit is linked with a particular fresh air flow, i.e. rate of air flow through the supply side of the air treatment unit.

The stored air flow data may alternatively take the form of parameters for a formula, optionally including the formula itself as a part of the stored data. Thus, the calibration process may include fitting the measurements to a curve or to a suitable predefined form of formula, and then storing the formula or parameters of the formula at the memory. One example of this is to fit the measured data to a curve of the form:

$$Q=(a\times dP\hat{}b)+c$$

such as where a and c are constants, and b=2, some other integer value, or any other value. In some cases b may be a floating point. The data may be fit to any other curve to estimate the rate of air flow, Q, across the air treatment unit such as a curve that includes at least one function of dP with a term of the type above. Such a formula may optionally include added constants or linear terms, e.g. one or more of a constant value or a value linearly in proportion with the drop in pressure dP. This might be expressed in a general way as a formula of the form:

$$Q=(a1\times dP\hat{}b1)+(a2\times dP\hat{}b2)+(a3\times dP\hat{}b3)+\ldots+(an\times dP\hat{}bn)+\ldots+c$$

where any of the constants c, a1, a2, a3, an, etc. can be zero, such that the relevant term does not contribute to the end value of the air flow, Q, and where b1, b2, b3, . . . , bn are integer values, e.g. 1, 2, 3, . . . , n, or more generally may be any floating point value.

The air treatment unit sensor is for measuring a pressure drop across the air treatment unit and may be any suitable differential pressure sensor. The exhaust fan sensor and supply fan sensor can be implemented in various ways. They may be sensors integrated with the respective fan, e.g. provided by the manufacturer, for the purpose of determining air flow. One possibility is to use a differential pressure sensor along with suitable data concerning fan parameters. Other possibilities include sensing of parameters such as fan speed, air speed at the fan, or electrical parameters of electricity used by the fan. The exhaust fan sensor and supply fan sensor may be located as is required to achieve the function of enabling determination of air speed. Typically, they may be located close to the respective fan.

The air treatment unit may comprise treatment devices for providing one or more of: heat and/or humidity transfer between the return air and the fresh air, filtering of the fresh air, or other treatments leading to a pressure drop for the fresh air. The air treatment unit may in some implementations give rise to a treatment effect for the return air as well as the fresh air, e.g. in case of heat and/or humidity transfer between air in the return and supply air flow paths. An treatment device including the ability for heat and/or humidity transfer between the return air and the fresh air, is typically referred to as a recovery unit, and may for example be embodied as a recovery wheel or a plate heat exchanger. Thus, the air treatment unit may comprise a recovery unit such as a recovery wheel as the air treatment device.

In some examples, a recovery unit of the air treatment unit is provided for heat and/or humidity transfer between the return air and the fresh air. The recovery unit is hence fluidly connected to the return air path and also fluidly connected to the supply air path. In some examples the recovery unit (e.g. recovery wheel) is for heat recovery only.

The air treatment unit may alternatively or additionally include other treatment devices, such as filters for filtering of the air. Where multiple treatment devices are present then the air treatment unit sensor advantageously measures the pressure drop over all of the treatment devices, i.e. the total air pressure drop over the whole extent of the air treatment unit in the supply air path.

The exhaust fan is a fan for urging air along the return air path. This may comprise urging air along a return air path from the return air inlet through a part of the air treatment unit and to the exhaust air outlet, i.e. when the air treatment unit has a treatment effect on both of the fresh air and the return air. In that case the return air path extends from the return air inlet through a part of the air treatment unit and to the exhaust air outlet. Typically, the exhaust fan may be located close to the exhaust air outlet, with the air treatment unit in between the exhaust fan and the return air inlet. Thus, the exhaust fan may draw return air toward itself, from the return air inlet and through the air treatment unit, before expelling the exhaust air to atmosphere via the exhaust air outlet.

The supply fan is a fan for urging air along the supply air path. The supply air path extends from the fresh air inlet through the air treatment unit and to the supply air outlet. Typically, the supply fan may be located close to the supply air outlet, with the air treatment unit in between the supply fan and the fresh air inlet. Thus, the supply fan may draw fresh air toward itself, from the fresh air inlet and through the air treatment unit, before providing the supply air via the supply air outlet, e.g. providing it to part of a HVAC system.

The mixing damper is for controlling air flow between the return air path and the supply air path. It may be located in a wall between the return air path and the supply air path. Where the air treatment unit has a treatment effect involving the return air then the mixing damper may typically be located in the return air path at a point between the return air inlet and the air treatment unit. The mixing damper may be configured to provide air to the supply air path at a point between the air treatment unit and the supply fan. In this way the mixing damper allows for recycling of air from the return air inlet to the supply air outlet, where with the mixing damper open or partially open then action of the supply fan can cause a portion of the return air to be diverted through the mixing damper to mix with the supply air. The mixing damper may have a variable degree of opening, which may be controlled (e.g. via the control system) based on a set point such as a required proportion of recycling of air or a required volume of fresh air. Set points may also be used for control of the volume of supply air (e.g. via control of the supply fan).

The air handling unit includes return and supply air paths as discussed above and the air paths may be contained within a suitable system of ducts or walls. Thus, for example, there may be a first duct enclosing the return air path and a second duct, optionally adjacent the first, enclosing the supply air path. The first duct may extend from the return air inlet to the exhaust air outlet. The second duct may extend from the fresh air inlet to the supply air outlet. The air paths in the ducts may be connected by action of the mixing damper. By use of the air treatment unit then the air paths in the ducts may be subject to heat and/or humidity transfer processes.

The control system comprises at least one memory and at least one processor. The processor has the function of determining operating parameters of the air handling unit and this includes at least using use the air flow data stored in the memory along with the measured pressure drop from the air treatment unit sensor in order to determine the rate of fresh air flow. The control system (e.g. the processor) may additionally receive signals from the exhaust fan sensor and/or the supply fan sensor and use those signals in relation to control of the air handling unit, such as by determining air flow rates from the sensor signals and/or processing the signals/air flow rates to determine one or more output signal(s). The output signal(s) may include one or more of a signal for another controller inside or outside of the air handling unit, e.g. a controller of a wider HVAC system; a signal for control of the fan speed for the exhaust fan and/or for the supply fan; a signal for control of the mixing damper, e.g. controlling its degree of opening; and/or data signals for other systems. The control system may receive input signals from outside of the air handling unit, such as one or more of a signal from another controller outside of the air handling unit, e.g. a controller of a wider HVAC system; a set-point signal relating to supply air flow rate; a set point signal relating to fresh air flow rate or the required proportion of fresh air; and/or a set point signal relating to supply air temperature. The control system can comprise multiple processors with the processing tasks distributed between processors.

The control system may be configured to perform the calibration process discussed above, and hence the processor (or a processor of multiple processors) may be configured to perform this calibration process, with the resulting air flow data being stored by the processor on the memory of the control system.

It will be apparent that one possible use for the air handling unit is for a building. Thus, the return air may be from a building, e.g. from a conditioned space in the building, and the supply air may be for a building, e.g. for a conditioned space in the building. The return air inlet and supply air outlet may hence be for connecting to the building, e.g. via suitable ducts or other air flow passages. The air may be from and for a HVAC system of the building, e.g. a whole building system or a HVAC system for specific conditioned spaces. The air handling unit may provide supply air for multiple different parts of a building, optionally for multiple different air conditioning units therein.

The invention may be embodied as a HVAC system, e.g. a building HVAC system, comprising the air handling unit. Further, the invention may be provided via a building comprising such a HVAC system.

Viewed from another aspect, the invention extends to the use of an air handling unit as set out in the first aspect and optionally with other features as discussed herein. This may be use of the air handling unit to provide supply air within a HVAC system such as a building HVAC system.

The use of the air handling unit may comprise performing a calibration process as discussed above, such as via implementation of the method steps set out below and/or via use of a computer programme product as discussed below. The calibration process may be performed in order to obtain the stored air flow data or in order to update the stored air flow data.

An example method of use of the air handling unit includes carrying out a calibration process, wherein the calibration process includes measuring the differential pressure at the air treatment unit with the mixing damper fully closed and the supply fan speed varying. The method may comprise using an output of the supply fan sensor to determine a rate of air flow at the supply fan as the fan speed varies, and thereby mapping known rates of air flow across the air treatment unit against the pressure drop measured by the air treatment unit sensor. The method may then include determining a relationship between the pressure drop at the air treatment unit (referenced herein as dP) and the air flow through the air treatment unit and thereby determining air flow data to store at the memory in order to enable the air handling unit to operate as described for the first aspect. The determined relationship may be a formula for air flow Q as discussed above.

The method may comprise repeating the calibration process during later use of the air handling unit. For example, the calibration process may be repeated during maintenance or inspection of the air handling unit, and/or when components are replaced or cleaned.

In a still further aspect, the invention provides a computer programme product comprising instructions that, when executed on an air handling unit, will cause a control system of the air handling unit to perform a method including a calibration process; wherein the air handling unit is an air handling unit as set out in the first aspect and optionally with other features as discussed herein; and wherein the method comprises carrying out a calibration process, wherein the calibration process includes measuring the differential pressure at the air treatment unit with the mixing damper fully closed and the supply fan speed varying. The calibration process may have further features as discussed above.

BRIEF DESCRIPTION OF THE DRAWINGS

Certain embodiments of the present concept will be now be described by way of example only and with reference to the accompanying drawing in which:

FIG. 1 shows an air handling unit with mixing damper and air treatment unit.

DETAILED DESCRIPTION OF THE INVENTION

As seen in FIG. 1, an air handling unit 100 comprises a return air inlet 10 for receiving return air; an exhaust air outlet 12 for expelling exhaust air to atmosphere; a fresh air inlet 14 for receiving fresh air from atmosphere; and a supply air outlet 16 for providing supply air. A return air path 18, 20 extends from the return air inlet 10 toward the exhaust air outlet 12 and a supply air path 22, 24 extends from the fresh air inlet 14 via the air treatment unit 26 to the supply air outlet 16. The air paths may be within ducts separated by a wall.

Within the air handling unit 100 there is an air treatment unit 26 for treating at least a part of the fresh air via a treatment device that gives rise to a pressure drop. The air treatment unit 26 can include treatment device(s) for providing one or more of: heat and/or humidity transfer between the return air and the fresh air, filtering of the fresh air, or other treatments leading to a pressure drop for the fresh air. In the example of FIG. 1 this is a treatment device in the form of a recovery wheel 26 including the ability for heat and/or humidity transfer between the return air and the fresh air. The recovery wheel 26 is hence fluidly connected to the return air path 18, 20 and also fluidly connected to the supply air path 22, 24.

An air treatment unit sensor 38 is included for measurement of a pressure drop (e.g. differential pressure) over the air treatment unit 26, i.e. over the recovery wheel 26 of FIG. 1. This is used in order to determine air flows within the air treatment unit 26 as discussed further below.

In the return air path 18, 20 there is an exhaust fan 30 for urging air along the return air path 18, 20 toward the exhaust air outlet 12. In the supply air path 22, 24 there is a supply fan 28 for urging air along the supply air path 22, 24 from the fresh air inlet 14 and via the air treatment unit 26 to the supply air outlet 16. A supply fan sensor 32 can measure a parameter associated with air flow across the supply fan 28 and this measurement may be used to determine the rate of air flow at the supply fan 28. Similarly an exhaust fan sensor 34 can measure a parameter associated with air flow across the exhaust fan 30 and this measurement may be used to determine the rate of air flow at the exhaust fan 30. In this way, as is known in the art, data can be obtained concerning the air flow in the supply air path 22, 24 and the return air path 18, 20.

If the two air paths were sealed from one another, as is the case in some prior art systems, then the data from the fan sensors would be sufficient to know all of the air flows in the air handling unit 100. However, in this case the air handling unit 100 also includes a mixing damper 36 for controlling air flow between the return air path 18, 20 and the supply air path 22, 24 and for allowing recycling of air from the return air inlet 10 to the supply air outlet 16. With the mixing damper 36 open then air flow from the return air path 18, 20 to the supply air path 22, 24, such as for heat retention or to meet other user requirements. The result of this is that when using only the fan sensors it is not possible to determine all of the air flow rates, and for example the air flow rate for the return air 10 is no longer known, and neither is the air flow rate at the fresh air inlet 14.

To address this issue the present air handling unit 100 can make use of added data from the pressure drop over the air treatment unit 26. If this can give a measure of air flow at the air treatment unit 26 in the supply air path 22, 24 then the fresh air flow is known and then all of the air flows in the system can be derived. However, a problem arises in that the relationship between the pressure drop measured by the air treatment unit sensor 38 and the fresh air flow may vary for different air handling unit 100*s* and/or may change over time, e.g. as components wear or become dirty from use.

The air handling unit 100 proposed herein comprises a control system 50 comprising a memory for data storage and a processor for determining operating parameters of the air handling unit 100, wherein the control system 50 receives input from the supply fan sensor 32, the exhaust fan sensor 34, and the air treatment unit sensor 38. Advantageously, the memory includes stored air flow data concerning a relationship between a rate of fresh air flow at the fresh air inlet 14 and the measured pressure drop across the air treatment unit 26. This stored data can relate specifically to the unit in question and since the processor can be configured to use the stored air flow data and the measured pressure drop to determine the rate of fresh air flow then it becomes possible to derive all of the air flow rates for all of the inlets and outlets. This then allows for improved control of the speed of the exhaust fan 30 and/or the supply fan 28, even when the mixing damper 36 is fully or partly open.

The stored air flow data can be data that has been obtained by a calibration process including measuring the differential pressure at the air treatment unit 26 with the mixing damper 36 fully closed and the supply fan speed varying. Known rates of air flow across the air treatment unit 26 can be mapped against the pressure drop measured by the air treatment unit sensor 38. The calibration process can be performed quickly and easily to give air flow data that is specific for the air handling unit 100 and for its air treatment unit 26. The calibration process may be repeated periodically, e.g. during maintenance or inspection of the air handling unit 100, and/or when components are replaced or cleaned.

The calibration process can provide stored air flow data in the form of a look-up table stored via the memory. In this case then during use the control system 50 can use the look-up table to map given differential pressure measurement at the air treatment unit 26 with a particular fresh air flow rate.

The stored air flow data may alternatively involve fitting measurements of differential pressure, and the known air flow at the supply fan, to a curve or to a suitable predefined form of formula, and then storing the formula or parameters of the formula at the memory.

$$Q=(a1\times dP\hat{}b1)+(a2\times dP\hat{}b2)+(a3\times dP\hat{}b3)+\ldots+(\mathrm{an}\times dP\hat{}bn)+\ldots+c$$

where any of the constants c, a1, a2, a3, . . . an, etc. can be zero, such that the relevant term does not contribute to the end value of the air flow, Q, and where b1, b2, b3, . . . , bn are integer values, e.g. 1, 2, 3, . . . , n, or more generally may be any floating point value. In a simple example the stored air flow data may provide that:

$$Q=a\times dP2+c$$

It will of course be appreciated that 2 may be replaced with any point value larger than zero.

A use for the air handling unit 100 is for air in a building. With this example the return air is from the building, e.g. from a conditioned space in the building, and the supply air is for the building, e.g. for the conditioned space in the building. The return air inlet 10 and supply air outlet 16 are connected to the conditioned space in building suitable ducts or other air flow passages. This can be a part of a building HVAC system. The air handling unit 100 can hence be used to provide supply air within a HVAC system such as a building HVAC system, with the control system 50 giving better control by ensuring that all the air flow rates are known, even when the mixing damper 36 is open. The calibration process to obtain the stored air flow data may be performed during first use of the air handling unit 100, e.g. upon installation/commissioning, and the calibration process can then be repeated during later use of the air handling unit 100 such as during maintenance or inspection of the air handling unit 100, and/or when components are replaced or cleaned.

The control system 50 includes a processor and memory and within the control system 50 software products can be used to configure it to operate as required herein. With an air handling unit 100 having the sensors and so on described herein then the control system 50 can be advantageously configured via a computer programme product to enable the air handling unit 100 to perform the calibration process and to thereafter use the stored air flow data as set out above.

What is claimed is:

1. An air handling unit comprising:

a return air inlet for receiving return air;

an exhaust air outlet for expelling exhaust air to atmosphere;

a fresh air inlet for receiving fresh air from the atmosphere;

a supply air outlet for providing supply air;

an air treatment unit for treating at least a part of the fresh air via a treatment device that gives rise to a pressure drop;

an exhaust fan for urging air along a return air path from the return air inlet toward the exhaust air outlet;

a supply fan for urging air along a supply air path from the fresh air inlet via the air treatment unit to the supply air outlet;

a mixing damper for controlling air flow between the return air path and the supply air path and for allowing recycling of air from the return air inlet to the supply air outlet;

a supply fan sensor for measuring a parameter associated with air flow across the supply fan;

an exhaust fan sensor for measuring a parameter associated with air flow across the exhaust fan;

an air treatment unit sensor for measuring a pressure drop across the air treatment unit in the supply air path; and a control system comprising a memory for data storage and a processor for determining operating parameters of the air handling unit, wherein the control system receives input from the supply fan sensor, the exhaust fan sensor, and the air treatment unit sensor, wherein the memory comprises stored air flow data concerning a relationship between a rate of fresh air flow at the fresh air inlet and the measured pressure drop across the air treatment unit, wherein the processor is configured to use the stored air flow data and the measured pressure drop to determine the rate of fresh air flow; and wherein the control system is configured to perform a calibration process to obtain the stored air flow data, the calibration process including measuring the differential pressure at the air treatment unit with the mixing damper fully closed and the supply fan speed varying, using an output of the supply fan sensor to determine a rate of air flow at the supply fan as the fan speed varies, and mapping known rates of air flow across the air treatment unit against the differential pressure measured by the air treatment unit sensor.

2. The air handling unit as claimed in claim 1, wherein the stored air flow data takes a form of a look-up table stored via the memory, whereby a given measurement of differential pressure measurement, dP, at the air treatment unit is linked with a particular fresh air flow.

3. The air handling unit as claimed in claim 1, wherein the stored air flow data takes a form of parameters for a formula.

4. The air handling unit as claimed in claim 1, wherein the air treatment unit comprises the treatment device which includes an ability for heat and/or humidity transfer between the return air and the fresh air.

5. The air handling unit as claimed in claim 4, wherein the treatment device which includes the ability for heat and/or humidity transfer between the return air and the fresh air is a recovery wheel or a plate heat exchanger.

6. The air handling unit as claimed in claim 1, wherein the air treatment unit includes a filter for filtering of the fresh air.

7. The air handling unit as claimed in claim 1, wherein the exhaust fan is located close to the exhaust air outlet, with the air treatment unit in between the exhaust fan and the return air inlet; and the supply fan is located close to the supply air outlet, with the air treatment unit in between the supply fan and the fresh air inlet.

8. The air handling unit as claimed in claim 1, wherein the mixing damper is located in the return air path at a point between the return air inlet and the air treatment unit and configured to provide air to the supply air path at a point between the air treatment unit and the supply fan.

9. The air handling unit as claimed in claim 1, wherein the control system is configured to perform the calibration process in situ.

10. An air handling unit comprising:

an air handling unit comprising:

a return air inlet for receiving return air;

an exhaust air outlet for expelling exhaust air to atmosphere;

a fresh air inlet for receiving fresh air from the atmosphere;

a supply air outlet for providing supply air;

an air treatment unit for treating at least a part of the fresh air via a treatment device that gives rise to a pressure drop;

an exhaust fan for urging air along a return air path from the return air inlet toward the exhaust air outlet;

a supply fan for urging air along a supply air path from the fresh air inlet via the air treatment unit to the supply air outlet;

a mixing damper for controlling air flow between the return air path and the supply air path and for allowing recycling of air from the return air inlet to the supply air outlet;

a supply fan sensor for measuring a parameter associated with air flow across the supply fan;

an exhaust fan sensor for measuring a parameter associated with air flow across the exhaust fan;

an air treatment unit sensor for measuring a pressure drop across the air treatment unit in the supply air path; and a control system comprising a memory for data storage and a processor for determining operating parameters of the air handling unit, wherein the control system receives input from the supply fan sensor, the exhaust fan sensor, and the air treatment unit sensor, wherein the memory comprises stored air flow data concerning a relationship between a rate of fresh air flow at the fresh air inlet and the measured pressure drop across the air treatment unit, wherein the processor is configured to use the stored air flow data and the measured pressure drop to determine the rate of fresh air flow, wherein the stored air flow data includes parameters for a formula for determining fresh air flow, Q, where the differential pressure dP is fitted to a curve of the form:

$$Q=(a1\times dP\hat{}b1)+(a2\times dP\hat{}b2)+(a3\times dP\hat{}b3)+\ldots+(\mathrm{an}\times dP\hat{}bn)+\ldots+c$$

where c, a1, a2, a3, . . . an are constants, where any of the constants c, a1, a2, a3, . . . an can be zero, and where b1, b2, b3, . . . , bn are integer values.

11. A HVAC system comprising the air handling unit of claim 1.

12. A method of use of an air handling unit of claim 1 to provide supply air within a HVAC system, wherein the use of the air handling unit comprises performing a calibration process to obtain the stored air flow data, the calibration process including measuring the differential pressure at the air treatment unit with the mixing damper fully closed and the supply fan speed varying, using an output of the supply fan sensor to determine a rate of air flow at the supply fan as the fan speed varies, and mapping known rates of air flow across the air treatment unit against the differential pressure measured by the air treatment unit sensor.

13. The method as claimed in claim 12 including determining a relationship between the pressure drop at the air treatment unit and the air flow through the air treatment unit and thereby determining air flow data to store at the memory as the stored air flow data.

14. A non-transitory computer programme product comprising instructions that, when executed on an air handling unit as claimed in claim 1, will cause the control system of the air handling unit to perform a method including a calibration process including measuring the differential pressure at the air treatment unit with the mixing damper fully closed and the supply fan speed varying, using an output of the supply fan sensor to determine a rate of air flow at the supply fan as the fan speed varies, and mapping known rates of air flow across the air treatment unit against the differential pressure measured by the air treatment unit sensor.

* * * * *